United States Patent [19]

Banich et al.

[11] Patent Number: 4,694,591

[45] Date of Patent: Sep. 22, 1987

[54] TOE OFF ATHLETIC SHOE

[75] Inventors: Howard P. Banich, Grand Rapids; Daniel E. Norton, Rockford, both of Mich.

[73] Assignee: Wolverine World Wide, Inc., Rockford, Mich.

[21] Appl. No.: 723,197

[22] Filed: Apr. 15, 1985

[51] Int. Cl.[4] ..... A43B 5/00; A43B 13/18; A43B 23/08; A43B 13/12

[52] U.S. Cl. ..... 36/102; 36/114; 36/31; 36/30 R; 36/69

[58] Field of Search ..... 36/102, 103, 93, 92, 36/114, 31, 32 R, 28, 30 R, 25 R, 68, 69

[56] References Cited

U.S. PATENT DOCUMENTS

| | | | |
|---|---|---|---|
| 1,569,576 | 1/1926 | Raymond | 36/25 R |
| 1,598,809 | 9/1926 | Dressel | 36/28 |
| 2,199,853 | 5/1940 | Joyce | 36/92 |
| 2,538,373 | 1/1951 | Maling | 36/30 R |
| 2,547,480 | 4/1951 | McDaniel | 36/25 R |
| 2,691,832 | 10/1954 | Lurie | 36/31 |
| 2,817,163 | 12/1957 | Clark | 36/28 |
| 2,931,110 | 4/1960 | Pietrocola | 36/30 |
| 3,952,429 | 4/1976 | Thomas | 36/31 |
| 4,128,950 | 12/1978 | Bowerman et al. | 36/28 |
| 4,182,055 | 1/1980 | Turner, Jr. | 36/30 R |
| 4,236,326 | 12/1980 | Inohara | 36/29 |
| 4,259,792 | 4/1981 | Hauberstadt | 36/28 |
| 4,288,929 | 9/1981 | Norton et al. | 36/69 |
| 4,322,895 | 4/1982 | Hockerson | 36/69 |
| 4,335,530 | 6/1982 | Stubblefield | 36/83 |
| 4,364,188 | 12/1982 | Turner et al. | 36/31 |
| 4,364,189 | 12/1982 | Bates | 36/30 R |
| 4,377,041 | 3/1983 | Alchermes | 36/31 |
| 4,398,357 | 8/1983 | Batra | 36/31 |
| 4,439,936 | 4/1984 | Clarke et al. | 36/102 |
| 4,481,727 | 11/1984 | Stubblefield | 36/83 |
| 4,484,397 | 11/1984 | Curley, Jr. | 36/92 |
| 4,498,251 | 2/1985 | Shin | 36/30 R |
| 4,506,462 | 3/1985 | Cavanagh | 36/31 |
| 4,557,059 | 12/1985 | Misevich et al. | 36/32 R |
| 4,564,966 | 1/1986 | Chen | 12/146 BR |

FOREIGN PATENT DOCUMENTS

| | | | |
|---|---|---|---|
| 0096542 | 12/1983 | European Pat. Off. | 36/114 |
| 2751146 | 5/1979 | Fed. Rep. of Germany | 36/31 |
| 952961 | 11/1949 | France | 36/30 R |

*Primary Examiner*—Werner H. Schroeder
*Assistant Examiner*—Steven N. Meyers
*Attorney, Agent, or Firm*—Price, Heneveld, Cooper, DeWitt & Litton

[57] ABSTRACT

An athletic shoe having a midsole subassembly formed of a lower layer and an upper layer, the lower layer having a rear higher density portion terminating short of the front end and integrally bonded with a lower density toe off pad portion into which the toes can sink during toe off. The upper layer extends beneath the heel and forwardly, terminating short of the toe area. This upper layer and the toe off pad have cooperative transverse grooves which are located relative to each other and to vertical flex grooves in the medial and lateral sides of the shoe upper, to enable the shoe to flex in a smooth curve with the foot. This upper layer has overlapping, laterally tapered wedge portions of different density and an integral, upstanding heel stabilizing cup, one portion from each wedge. The outsole has portions of different densities, the heel and ball portions of greater density for wear durability.

5 Claims, 9 Drawing Figures

TOE OFF ATHLETIC SHOE

BACKGROUND OF THE INVENTION

This invention relates to athletic footwear for runners, joggers and the like.

As is well known to those familiar with the athletic footwear industry, the increased public interest in participating athletic activities involving running in recent years has stimulated important developments in the age old technology of footwear construction. Although a primary motivation for such participation is improved health, a result of the constantly increasing participation is improved competitive capabilities of the participants. This generates a demand for footwear that will not cause a competitive disadvantage, i.e. will enable the participant to reach full physiological potential, and will minimize physical damage to the body. Optimally, such footwear should enhance the natural biomechanics of the foot, effect motion control and stability, be light in weight, and provide excellent comfort as well as exhibiting footwear durability.

Many structural improvements have been developed and patented previously. However, the inventors herein believe that the shoe of this construction effects a unique combination constituting a further improvement in athletic footwear.

SUMMARY OF THE INVENTION

The athletic shoe of the present invention has a novel structure effecting motion control and stability in a highly cushioned, lightweight and physically durable shoe. Although it is believed that runners with minor stability/motion control requirements will benefit most from the novel shoe, others should also find it of significant advantage. The shoe possesses a unique toe off pad midsole feature enabling more efficient forward momentum during toe off in the running gait, plus extra cushioning under the ball of the foot. This allows the metatarsals to align naturally, and balances the forces the foot experiences during toe off. Such is combined with deflection midsole cushioning at the heel area. The outsole possesses integral portions of differing densities, combining durability with comfort. There is a cooperative relationship between transverse flex grooves in the midsole, in the toe off pad portion, and in the forward end of the rear portion, specially located with respect to each other and with respect to vertical flex grooves in the lateral and medial sides of the shoe upper, to achieve a smooth and continuous flex curvature of the shoe with the progressive flexure of the foot during mid-stance and toe off. The midsole also includes an upper layer forming a dual density heel possessing a roll bar wedge with an integrally molded stabilizer cup extending upwardly therefrom.

The result enhances the natural biomechanics of the foot during all phases of the gait cycle.

DESCRIPTION OF THE PREFERRED EMBODIMENT

Figure 1:
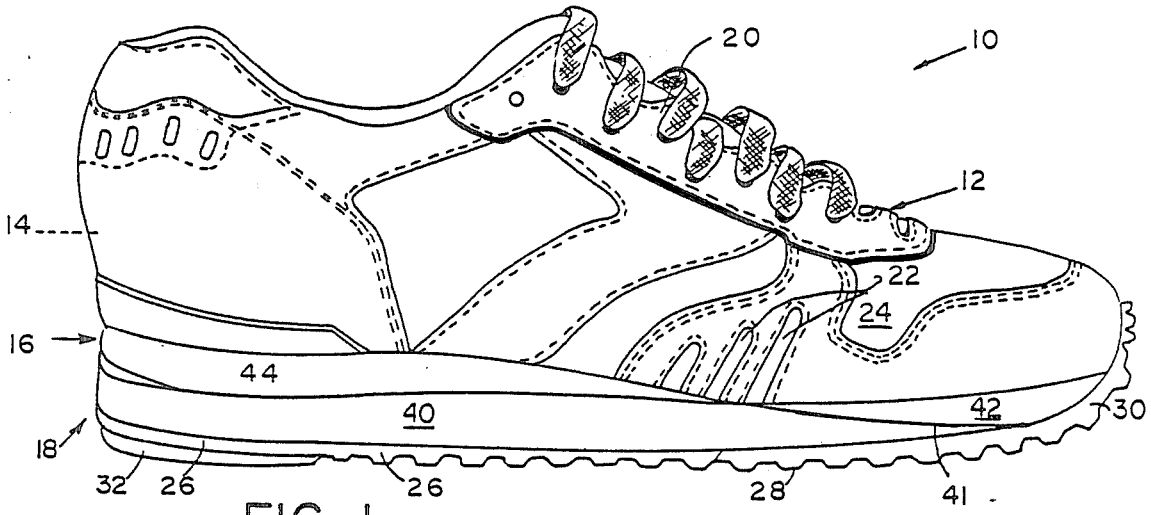
FIG. 1 is a side elevational view of the lateral side of the novel shoe.

Referring now specifically to the drawings, the complete shoe 10 there depicted comprises the typical elements of a shoe upper 12 which incorporates an inner heel last 14, a midsole subassembly 16, and an outsole subassembly 18. Preferably, an insole (not shown) is also employed on top of the midsole.

Shoe upper 12 includes the usual components stitched and bonded together to encompass the wearer's foot, and provide lacing eyelet strips 20 for conventional laces. This upper includes a plurality of vertical flex grooves or notches 22 on both the lateral side (FIG. 1) of the shoe and the medial side (FIG. 2) of the shoe. These grooves slope upwardly, forwardly and are located just behind transverse grooves or notches in the midsole assembly to cooperate therewith as explained hereinafter. Grooves 22 are formed by cutout portions in the leather toe 24 of the upper, exposing the underlying thin more flexible layer of woven fabric as of nylon.

Outsole subassembly 18 is composed of portions of different densities. Portion 26 extends from the rear end of the shoe forwardly to the higher density portion 28 under the ball of the foot. Portion 26 constitutes an expanded rubber of about 45 durometer, Shore A. Likewise, the front toe portion 30 of the outsole is an expanded rubber of about 45 durometer, Shore A. The intermediate portion 28 beneath the ball of the foot constitutes an expanded rubber of about 65 durometer. The portion 32 at the heel of the outsole constitutes a solid rubber heel plug of about 65 durometer, inserted into a recess in portion 26. Preferably solid rubber wear inserts of about 85 durometer, Shore A are placed on the lateral side of the heel at 34.

Figure 3:
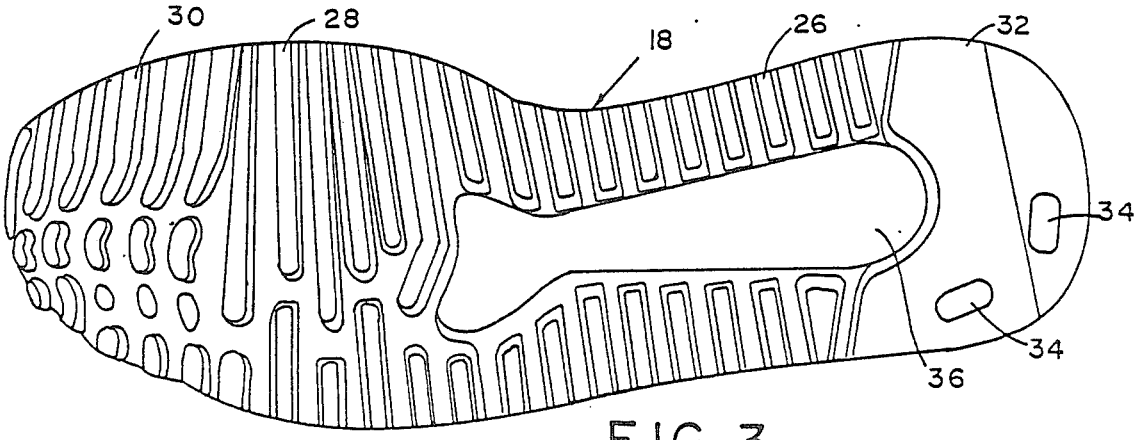
FIG. 3 is a bottom view of the shoe.
Figure 8:
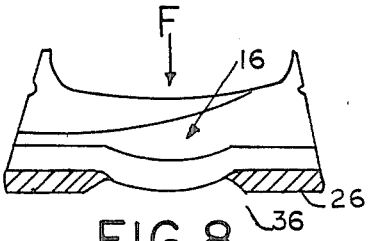
FIG. 8 is a sectional view comparable to FIG. 7 but under load.
Figure 7:
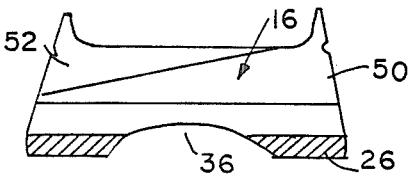
FIG. 7 is a framentary sectional diagrammatic view through the heel portion of the shoe.

A central elongated cutout recess 36 is located in the outsole (FIG. 3), extending from the heel to the portion 28 beneath the ball of the foot. A slight protrusion 40' (FIG. 9) on the bottom of the midsole is shaped like opening 36 to align therewith. This elongated cutout recess enables the midsole to deflect under impact force, downwardly through the outsole, during heel impact while the user is running. The deflection effects cushioning and results in less compaction, to enhance the cushioning properties and durability of the midsole. This deflection is graphically depicted in the sectional views FIGS. 7 and 8. In FIG. 7, the midsole subassembly 16 is depicted relative to outsole portion 26 and opening 36 therein, with only the slight protrusion 40' of the midsole extending into this opening for secure positioning. In FIG. 8 is depicted the effect of force F applied by the runner's heel during impact, to deflect or bend midsole subassembly 16 downwardly into and possibly through opening 36 to ultimately engage the surface run upon, at which time the midsole material is then compressed somewhat. The deflection and subsequent compression effects excellent cushioning. The removal of this portion of the outsole also lowers the weight of the outsole and shoe.

Midsole subassembly 16 is formed of several components bonded into an integral structure. It has a lower layer composed of a rear portion 40 (FIG. 1) and a toe off pad 42. This rear portion 40 extends from the rear of the shoe toward the toe of the shoe but terminates short of the front end of the shoe in a tapered front zone, i.e. downwardly and forwardly to provide a surface which faces upwardly to form a bonded interface 41 to the overlapping bottom rear face formed by an upwardly, rearwardly tapering zone at the rear end of toe off pad portion 42.

Rear portion 40 is formed of compression molded EVA, having a density or hardness of about 35 durometer, Shore A. Toe off pad 42 is also formed of compression molded EVA but having considerably less density and greater compressibility than that of the rear portion of this lower layer of about 25 durometer, Shore A. Thus, the significantly lower durometer enables the user's metatarsals to sink into the toe off pad during the midstance and toe off portions of the gait cycle. It also provides extra cushioning under the ball of the foot because the tapered part of the toe off pad extends rearwardly beneath the ball of the foot. The downwardly, forwardly tapered interface arrangement 41 effects a gradual transition as well as significant area of bonding.

Figure 2:
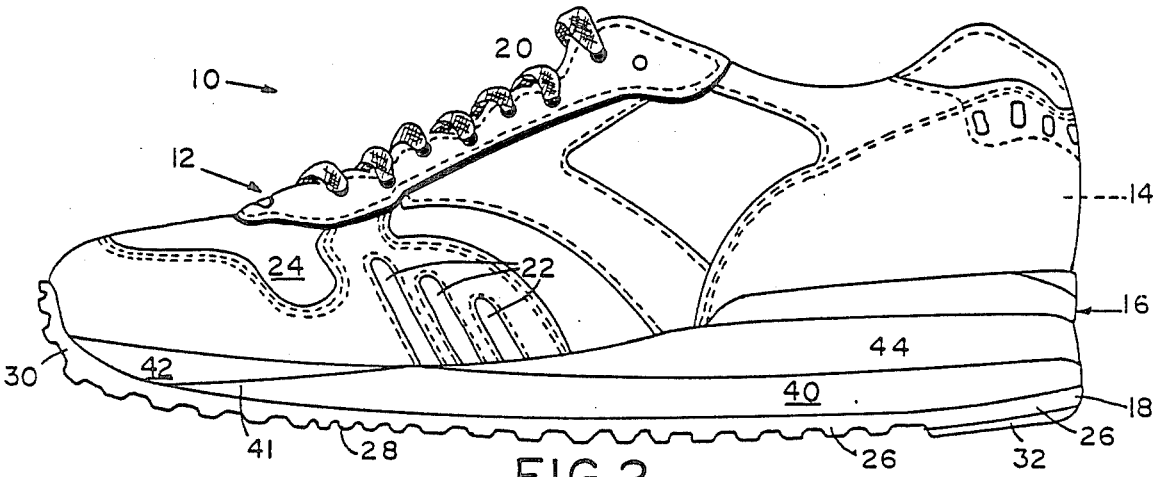
FIG. 2 is a side elevational view of the medial side of the novel shoe.
Figure 4:
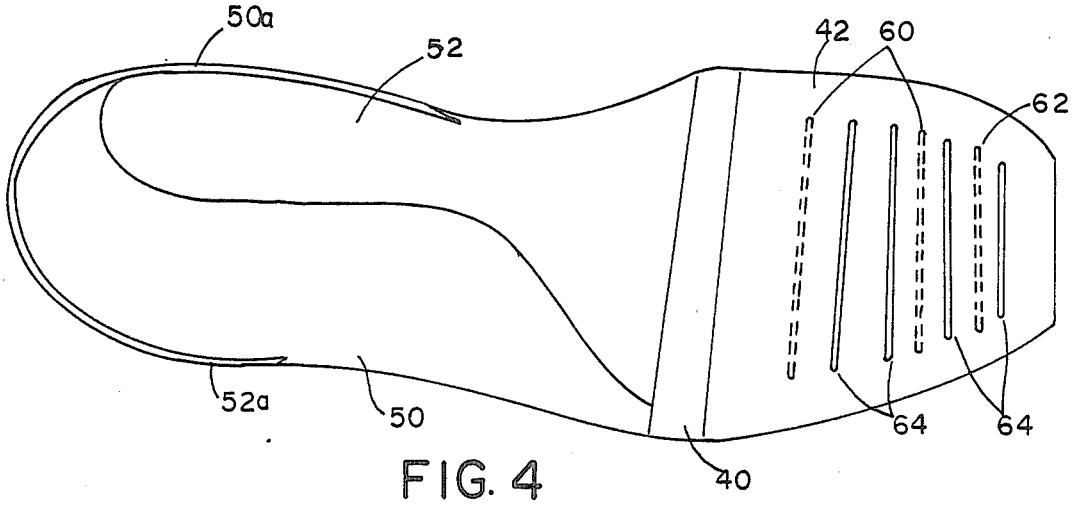
FIG. 4 is a top view of the midsole subassembly.
Figure 5:
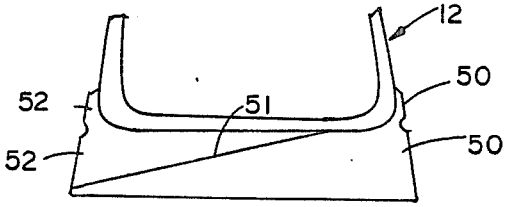
FIG. 5 is a fragmentary sectional view through the heel portion of the shoe upper and the upper layer of the midsole.

Bonded upon the upper surface of this lower layer is an upper layer 44, elevating the heel of the foot and tapering downwardly forwardly under the instep of the foot to terminate short of the ball of the foot and short of toe off pad 42 (see FIGS. 1 and 4). At the heel of this upper layer, it forms a roll bar wedge of overlying, laterally tapered wedge portions of different density. Wedge portion 50 (FIG. 5) having its thicker edge on the medial side of the shoe is of substantially greater density than overlying wedge portion 52 on the lateral side. Specifically, wedge portion 50 has a density of about 45 durometer while wedge portion 52 is of about 32 durometer. These are compression molded-bonded together integrally at interface 51. Also integral with these wedge portions are upstanding curvilinear wall segments 50*a* and 52*a* respectively on the medial and lateral sides of the shoe, with wall 52*a* also extending around the rear of the shoe in the embodiment depicted, to be integrally joined with wall 50*a* on the medial side (FIG. 4). These integrally interconnected walls form a stability cup into which the shoe upper 12 (FIG. 5) fits for stabilizing the foot around the heel. The integral structure of this assembly removes the necessity of a separate conventional reinforcing exterior counter. Such a conventional exterior counter requires uncompressible portions extending beneath the foot, with these portions undesirably lessening cushioning.

Figure 9:
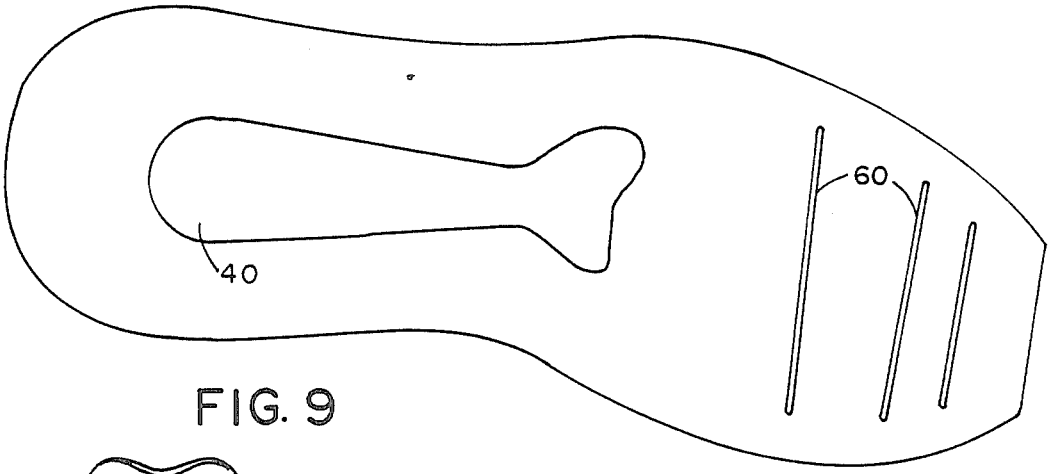
FIG. 9 is a bottom view of the midsole subassembly.
Figure 6:
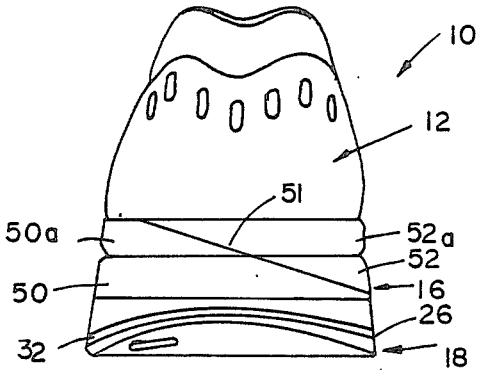
FIG. 6 is a rear elevational view of the shoe.

At the front end of the bottom surface of rear portion 40 of the lower layer are transversely extending flex grooves 60 (FIGS. 4 and 9). Forwardly of these two grooves and in the bottom surface of the toe spring portion 42 is another groove 62. In the top surface of toe spring portion 42 is a series of spaced, transverse flex grooves 64. As will be noted from FIG. 4, all of these grooves 60, 62 and 64 are spaced in sequence and do not coincide with each other, the effect being, especially in combination with medial and lateral grooves 22 in the shoe upper to the rear thereof, the formation of a smooth, parabolic curvature in the shoe as the runner's weight moves from the planted position to the toe off position.

It is conceivable that certain variations may be made in the construction disclosed and described above as the preferred embodiment, yet without departing from the novel concept presented. Therefore, such variations are considered to be within the scope of the invention if encompassed by the scope of the appended claims or are reasonably equivalent thereto.

The embodiments of the invention in which an exclusive property or privilege is claimed are defined as follows.

1. An athletic shoe having an outsole, an upper, and a midsole subassembly therebetween, said midsole subassembly comprising:

a compressible layer having a rear portion extending forwardly from the rear of the shoe toward the toe of the shoe but terminating short of the front end of the shoe in a tapered front zone;

said layer also having a highly compressible toe off pad with a tapered rear zone overlapping and bonded integrally with said tapered front zone;

said toe off pad underlying the toe area of the shoe and having a density substantially less than that of said rear portion, and sufficiently low to allow the user's metatarsals to sink into said toe off pad during toe off action;

said athletic shoe including a lower layer and an upper compressible layer bonded to said lower layer and extending forwardly from the rear of the shoe but terminating short of said toe off pad and wherein said upper layer is formed of overlying, laterally tapered wedge portions of different density, the wedge portion having a thicker edge on the medial side being of substantially greater density than that of the wedge portion having a thicker edge on the lateral side; and said upper layer having an integral, upstanding stability heel cup, the medial side of which is of said greater density material and the lateral side of which is of the lesser density material.

2. The shoe in claim 2 wherein said rear portion is about 35 durometer Shore A hardness, said toe portion is about 25 durometer Shore A hardness, said upper layer medial side wedge portion is about 45 durometer Shore A hardness, and said upper layer lateral side wedge portion is about 32 durometer Shore A hardness.

3. An athletic shoe having an outsole, an upper, and a midsole subassembly therebetween, said midsole subassembly comprising:

a compressible layer having a rear portion extending forwardly from the rear of the shoe toward the toe of the shoe but terminating short of the front end of the shoe in a tapered front zone;

said layer also having a highly compressible toe off pad with a tapered rear zone overlapping and bonded integrally with said tapered front zone;

said toe off pad underlying the toe area of the shoe and having a density substantially less than that of said rear portion, and sufficiently low to allow the user s metatarsals to sink into said toe off pad during toe off action;

said tapered front zone of said rear portion of said layer having transverse flex grooves, said toe off portion having transverse flex grooves, and said shoe upper having vertical flex grooves on both the lateral and medial sides thereof, all of said grooves being cooperatively located to enable the forepart of said shoe to smoothly, curvably flex.

4. The athletic shoe in claim 3 wherein said front zone flex grooves are offset from said toe off pad flex grooves.

5. The athletic shoe in claim 3 wherein said toe off pad flex grooves are in the top and the bottom of said toe off pad.

* * * * *

UNITED STATES PATENT AND TRADEMARK OFFICE

CERTIFICATE OF CORRECTION

PATENT NO. : 4,694,591

DATED : September 22, 1987

INVENTOR(S) : Howard P. Banich and Daniel E. Norton

It is certified that error appears in the above-identified patent and that said Letters Patent is hereby corrected as shown below:

Column 4, line 35;

"claim 2" should be -- claim 1 --;

Column 4, line 53;

"user s" should be -- user's --.

Signed and Sealed this

Second Day of February, 1988

*Attest:*

*Attesting Officer*

DONALD J. QUIGG

*Commissioner of Patents and Trademarks*